US006830667B2

(12) United States Patent
Yamamoto

(10) Patent No.: US 6,830,667 B2
(45) Date of Patent: Dec. 14, 2004

(54) CATHODE CARTRIDGE AND ANODE CARTRIDGE OF TESTING DEVICE FOR ELECTROPLATING

(75) Inventor: Wataru Yamamoto, Tokyo (JP)

(73) Assignee: Yamamoto-MS Co., Ltd., Tokyo (JP)

( * ) Notice: Subject to any disclaimer, the term of this patent is extended or adjusted under 35 U.S.C. 154(b) by 0 days.

(21) Appl. No.: 09/883,995

(22) Filed: Jun. 20, 2001

(65) Prior Publication Data

US 2002/0040849 A1 Apr. 11, 2002

(30) Foreign Application Priority Data

Oct. 6, 2000 (JP) ..... 2000-306959

(51) Int. Cl.[7] ..... C25D 17/06; G01N 27/42

(52) U.S. Cl. ..... 204/286.1; 204/297.1; 204/434

(58) Field of Search ..... 204/286.1, 288.3, 204/297.01, 297.06, 297.1, 297.11, 297.14, 400, 434

(56) References Cited

U.S. PATENT DOCUMENTS 3,347,768 A * 10/1967 Clark et al.
3,824,159 A * 7/1974 Wehrmann
4,400,258 A * 8/1983 Hans Jurgen et al.
4,425,918 A * 1/1984 Moll et al.
5,744,019 A * 4/1998 Ang

* cited by examiner

*Primary Examiner*—Kaj K. Olsen
(74) *Attorney, Agent, or Firm*—Liniak, Berenato & White

(57) ABSTRACT

To provide a cathode cartridge, which comprises a tabular cathode conductor 5, which has an open hole having a same shape to that of plated pats 2*a* of a plated base 2 as a negative plate, which has a plurality of a protruding portion that presses contact to a peripheral part 2*d* around the plated parts 2*a*, a first elastic thin board 3, which covers a rear side of the plated base 2 and has a recess 3*a*, a tabular rear wall insulator 6, which covers both a back side of the cathode conductor 5 and a back side of the first elastic thin board 3, and has a recess 6*b*, a tabular front side insulator 7, which has an aperture having the same shape to that of the plated parts 2*a*, which covers a front side of the cathode conductor 5, and has a recess 7*b*, into which the cathode conductor 5 gets just, and a second elastic thin board 4, which has an aperture (open hole) having the same shape to that of the plated parts 2*a*, which is sandwiched between the cathode conductor 5 to provide a cathode cartridge of testing device for electroplating, in which it is able to intercept both a lateral side of the plated base and a peripheral part around the plated parts from the plating solution.

6 Claims, 12 Drawing Sheets

CATHODE CARTRIDGE AND ANODE CARTRIDGE OF TESTING DEVICE FOR ELECTROPLATING

BACKGROUND OF THE INVENTION

1. Field of the Invention

The present invention relates to a cathode cartridge and an anode cartridge of testing device for electroplating, particularly, with which silicon wafers, glass bases and ceramic bases etc. can be plated precisely.

2. Prior Art

Recently, plating technology has widely been used in various fields of technology, such as a wiring method applied to a semiconductor. In semiconductor fields it is required that a pitch of wiring distributed on a semiconductor is to be reduced in order to realize higher integration and higher performance thereof. Accordingly, in recent days, the wiring method, which is so called as Damascene Process, has been applied. That Damascene Process is a method, in which channels for wiring are maintained after setting up layer insulations by carrying out dry etching process, and then the distributing material for wiring is bedded in said channels.

Moreover, as one of the latest techniques, to which the plating technology is applied, there is another technique called as LIGA (Lithographie Galvanoformung Abformung), relating to manufacturing minute mechanical parts, in which acrylic resin is treated by X-ray to make a mold thereof and then metallic minute particles are made up by accumulating plating deposit thickly in the mold.

In order to materialize these plating techniques, it is required that the wiring material is accumulated with homogeneous broadening in a hollow dug place such as the channel of the mold. Therefore, in Japanese Patent Application No. 2000-152342 applied by the present patent applicant it has already been suggested that the homogeneous plating membrane on a plating side of a plated base could be formed in the patent application filed under the title of "a cathode cartridge of a testing device for electroplating and a testing device for electroplating".

As shown in FIG. 10, the current cathode cartridge (31) equipped with a testing device for electroplating comprises a plated base (32) that is a negative plate, a cathode conductor (33), a rear wall insulator (34), a front wall insulator (35) and an elastic thin board (36), wherein the cathode conductor (33), that is tabular, has a hole having a same shape to the outline of a plating side (32*a*) of the plated base (32) as negative plate, and has some protruding portions (33*a*), each of which is pressed to the plating side (32*a*) at periphery thereof, and in the part of the cathode conductor (33) which is not soaked in plating solution, there is an exposed portion to be able to be connected with a direct current electric source.

The rear wall insulator (34) covers both a back side of the plated base (32) and a back side of the cathode conductor (33) and has both a round dug place (34*a*), into which the plated base (32) is retained, and a channel part (34*b*), into which the cathode conductor (33) is retained.

The front insulator (35) has a cutting hole presenting the same shape to that of the plating side (32*a*) and covers a front side of the cathode conductor (33).

The elastic thin board (36) is sandwiched between the plated base (32) and the rear wall insulator (34).

Further, the conductor (33) is related to an electrical conductor such as metal and carbon, and also may be made up from electrical conductivity material spattered on a glass plate or the like.

SUMARY OF THE INVENTION

However, as shown in FIG. 11, according to a cathode of a testing device for electroplating found in Japanese Patent Application No. 2000-152342 there still remained a problem that the plating solution invaded both in the edge strip 32*b* of the plated base 32, and by the peripheral surface 32*c* of the plating side 32*a*.

Presently, for the purpose of manufacturing more advanced semiconductors mentioned above since there is a wiring for semiconductors constructed by using a line of 0.5 μm and below, it is required to provide a plating surface with a very minute plating precision.

Nevertheless, since in case that plating solution invades the cathode parts except the plated side of the plated base 32, an error occurs by a plated area and a minute plating precision cannot be obtained.

Moreover, as shown in FIG. 12, there was a difference in size between a side area of an anode 37 and an area of the plated side 32*a*, there was another problem that electric lines of force (arrows in FIG. 12) generated from an anode 37 could not enter uniformly into the plated side 32*a*.

Because the lines of electric force concentrate on a peripheral part of the plated side 32*a* from a flank of the plated side 32*a*, there is a tendency to thicken the plating thickness of a peripheral part thereof.

The present invention has been made the forgoing background in mind. It is the primary object of the present invention to provide a cathode cartridge of testing device for electroplating to intercept both a lateral side and a peripheral side of the plated base from plating solution.

Another object of the present invention is to provide an anode cartridge of a testing device for electroplating, in which lines of electric force generated from the anode can enter uniformly into a plated side of a plated base.

According to the present invention, there is provided a cathode cartridge used in a testing device for electroplating, which comprises: a tabular cathode conductor, which has an aperture (open hole) having a same shape to that of the plated parts of the plated base that is a negative plate, which has plural protruding portions to contact to a peripheral part around the plated parts, and which is able to connect with a direct current by an exposed portion thereof, which is not soaked in plating solution; a first elastic thin board, which covers a rear side of the plated base and has a groove part, into which the plated base is retained; a tabular rear wall insulator, which covers both a back side of the cathode conductor and a back side of the first elastic thin board, and has an aperture, into which the cathode conductor and the first elastic thin board is retained; a tabular front insulator, which has the aperture having the same shape to that of the plated parts, which covers a front side of the cathode conductor, and has a channel, into which the cathode conductor is retained; a second elastic thin board, which has an aperture (open hole) having a same shape to that of the plated parts, which is sandwiched between the cathode conductor and the plated base, and has a hole through which the protruding portion of the cathode conductor is guided for passing through.

Owing to the mentioned above construction, both the lateral side of the plated base and peripheral parts around the plated parts can be prevented from plating solution's invading, and therefore minute plating accuracy is achieved.

Furthermore, according to the present invention, there is also provided an anode cartridge used in an electroplating testing device, which comprises: a tabular anode conductor, which is arranged to let a front side of the cathode cartridge be opposite thereto and has a exposure part, which can connect with direct current on the part which does not soak in plating solution; a tabular first insulator, which wraps the side of the anode conductor, that faces in the opposite direction of the cathode cartridge, and which has a hollow part into which the anode conductor is retained; a tabular second insulator, which has an opened hole that is the same figure corresponded to that of the plated parts, and covers a side of the anode conductor, that faces in direction of the cathode cartridge.

By such a constitution thereupon, an exposure of the anode conductor is limited to only a part that is opposing to a shape of the plated parts and then lines of electric force generated from a positive pole can enter into the plated parts of the plated base uniformly.

Consequently, a uniform plating membrane is formed on the plated parts.

Then, as to the second insulator, it is detachable to the first insulator or the anode conductor.

With constituting it in this way, according to a shape of the plated parts of the plated base, the second insulator can be changed, in which there is a hole formed which has a same shape corresponding to that of said plated parts.

DESCRIPTION OF THE PREFERRED EMBODIMENT

Referring to a preferred embodiment, this invention will be described in further detail with reference to the accompanying drawings.

Figure 1:
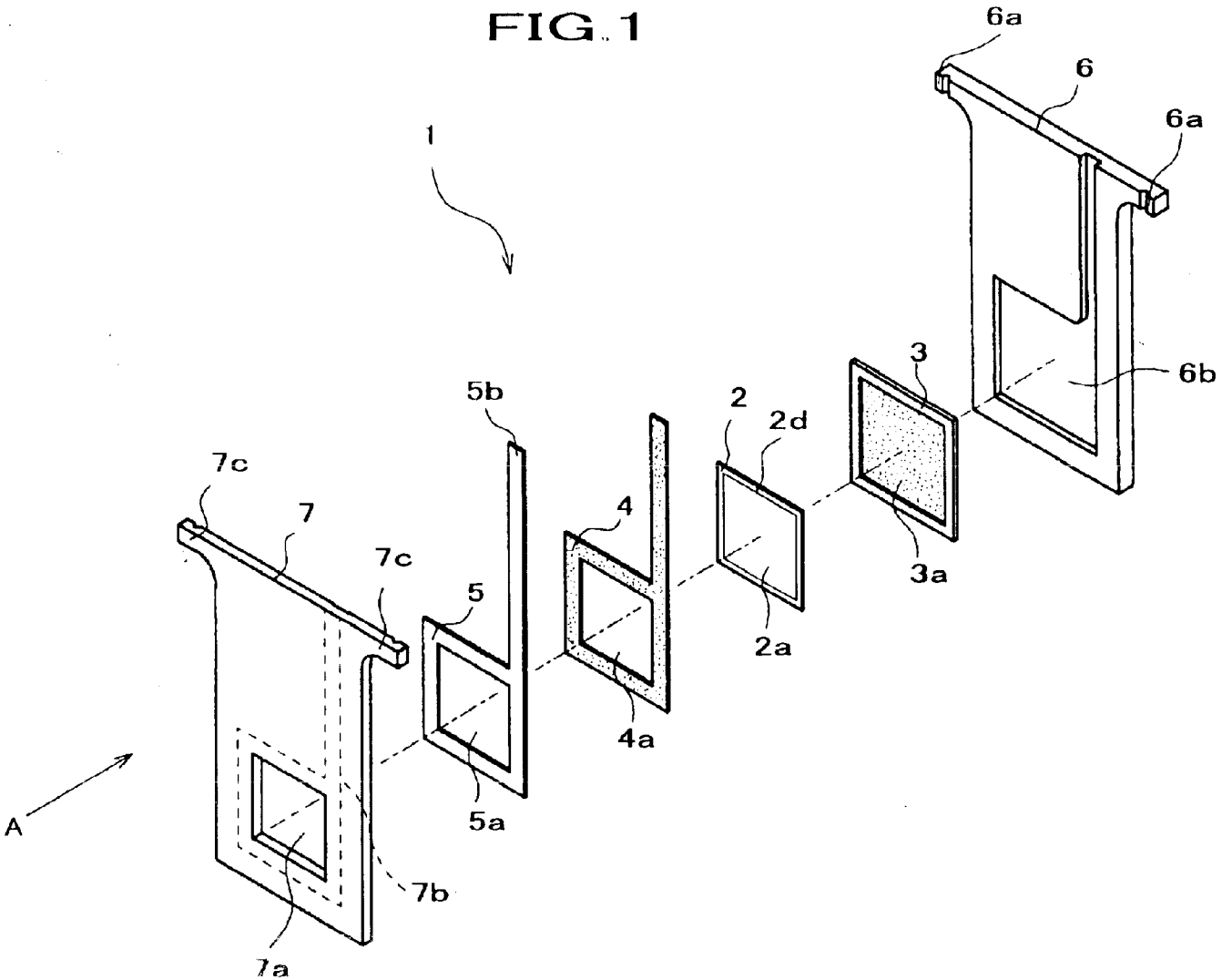
FIG. 1 is an exploded perspective illustration of a cathode cartridge of testing device for electroplating, according to the present invention.

FIG. 1 is an exploded perspective illustration of a cathode cartridge 1 of testing device for electroplating and a silicon wafer 2 according to the present invention.

As shown in FIG. 1, a cathode cartridge 1 comprises: a silicon wafer 2 that is a plated base, a first elastic thin board 3 arranged in the direction of the reverse (hereinafter referred to as a back side) of a plated parts 2*a* of the silicon wafer 2 and a back side insulator 6, a second elastic thin board 4 arranged in the direction of the plated parts 2*a* (hereinafter referred to as a front side) of the silicon wafer 2, a cathode conductor 5, and a front side insulator 7.

As for the silicon wafer 2, it is made in the form of a thin board and put on the first elastic thin board 3 as a rubber with being elastic, that is in the direction of a back side of the silicon wafer 2.

Figure 4:
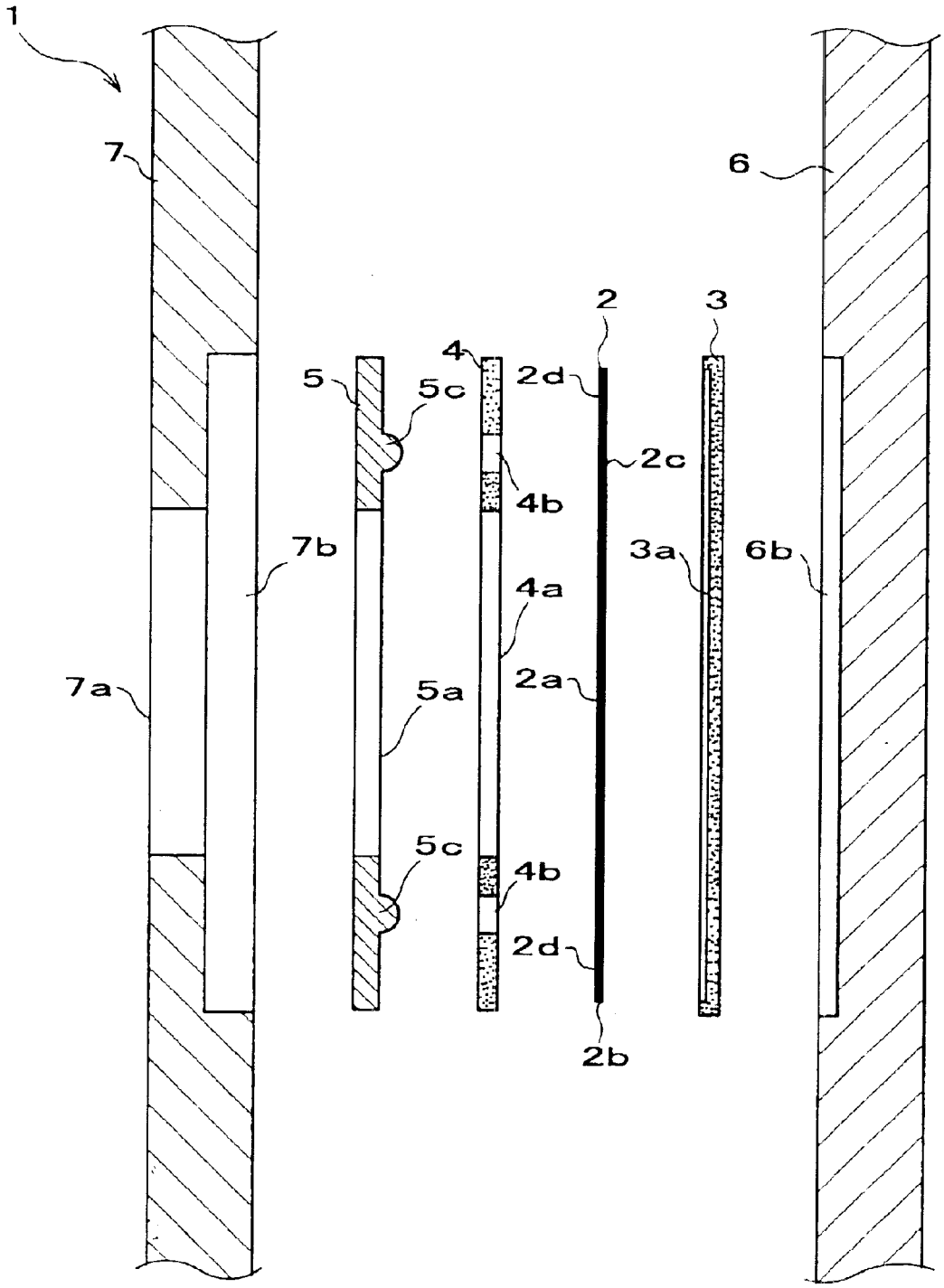
FIG. 4 is an exploded view of FIG. 3.

Referring to the first elastic thin board 3, there is a recess 3*a* provided in inside thereof, in which the silicon wafer 2 matches just tight, and by which, as shown in FIG. 4, both a side surface 2*b* and a back surface 2*c* of the silicon wafer 2 are just matched therein to be intercepted from the plating solution's invading thereon.

The second elastic thin board 4 having a rubber like elastic property is laid on the front side of the silicon wafer 2, and which has an open hole 4*a* created on with a same shape to that of the plated parts 2*a*, and is stuck fast on the front side of silicon wafer 2 to intercept peripheral parts 2*d* around the plated parts 2*a* from plating solution's invading.

Furthermore, as shown in FIG. 4, there is a hole (a cavity) 4*b* provided in peripheral part of the second elastic thin board 4, by which, as touched upon later, a protruding portion 5*c* of the cathode cartridge 5 is guided for passing through.

Moreover, the cathode conductor 5 made of a stainless thin board is put on a front side of the silicon wafer 2 with the second elastic thin board 4 between, which comprises an open hole 5*a* having a same shape to that of the plated parts 2*a*; a power supply connecting part 5*b*, which is in the form of a strip (a tanzaku) that elongates above from the open hole 5*a*.

Figure 3:
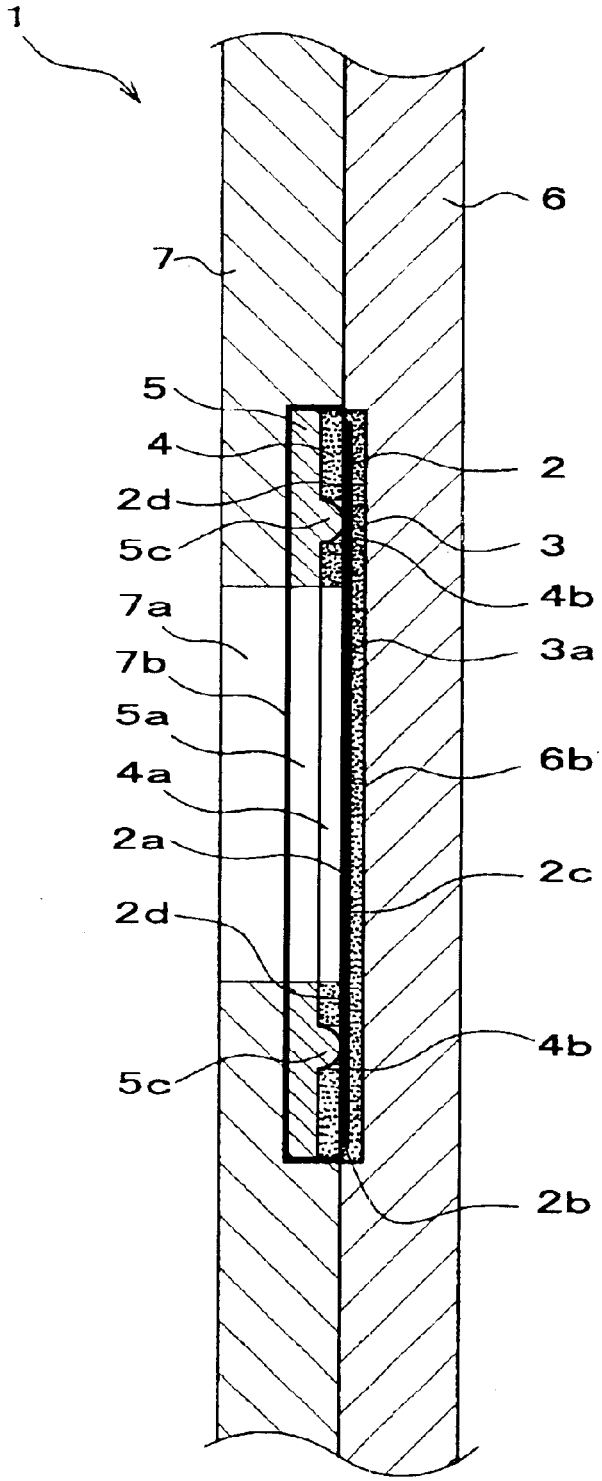
FIG. 3 is a sectional view taken along B—B line of FIG. 2.

Besides, as shown in FIG. 4, a protruding portion 5*c* is made in a fixed interval around the open hole 5*a*, which is put on a peripheral part 2*d* of the plated parts 2*a*. As shown in FIG. 3, in case of putting the cathode conductor 5 on the second elastic thin board 4, the protruding portion 5*c* is reached at the peripheral part 2*d* of a silicon wafer 2 with passing through by the hole 4*b* provided in the second elastic thin board 4. As for a cathode conductor 5, it is possible to use a copper plate or the like.

Each front side of the first elastic thin board 3 and the cathode conductor 5 is covered by a back side insulator 6 made of acrylic board. The back side insulator 6 is equipped with an insulator to be supported 6*a* at each shoulder thereof, by which the cathode cartridge 1 is hung on a plating tank of testing device for electroplating.

Referring to a front side (surface) of the back side insulator 6, which makes contact with both the elastic thin board 3 and the cathode conductor 5, there is a recess 6*b* provided in it for both the elastic thin board 3 and the cathode conductor 5 to fit in tight.

As to a front side of the cathode conductor 5, there is the front side insulator 7 provided to cover it, which has an open hole 7*a* formed into a same shape to that of the plated parts 2*a*, and there is a recess 7*b* provided in the surface which the cathode conductor 5 has contact with, for the cathode conductor 5 to fit in tight.

Besides, in the same way to that of the back side insulator 6, the front side insulator 7 is equipped with an insulator to be supported 7*c* at each shoulder thereof, to hang the cathode cartridge 1 on a plating tank of testing device for electroplating.

Furthermore, as shown in FIG. 3, since both the back side insulator 6 and the front side insulator 7 are fixed firmly each other by using resin-made-screws (not shown), the silicon wafer 2, the first elastic thin board 3, the second elastic thin board 4 and the cathode conductor 5, which are sandwiched between the above mentioned both side insulators 6 and 7, and are tightly fixed all.

As for the elastic thin board 3, the second elastic thin board 4 and the cathode conductor 5, they can be combined, also, by taking a measure such as clip.

Figure 2:
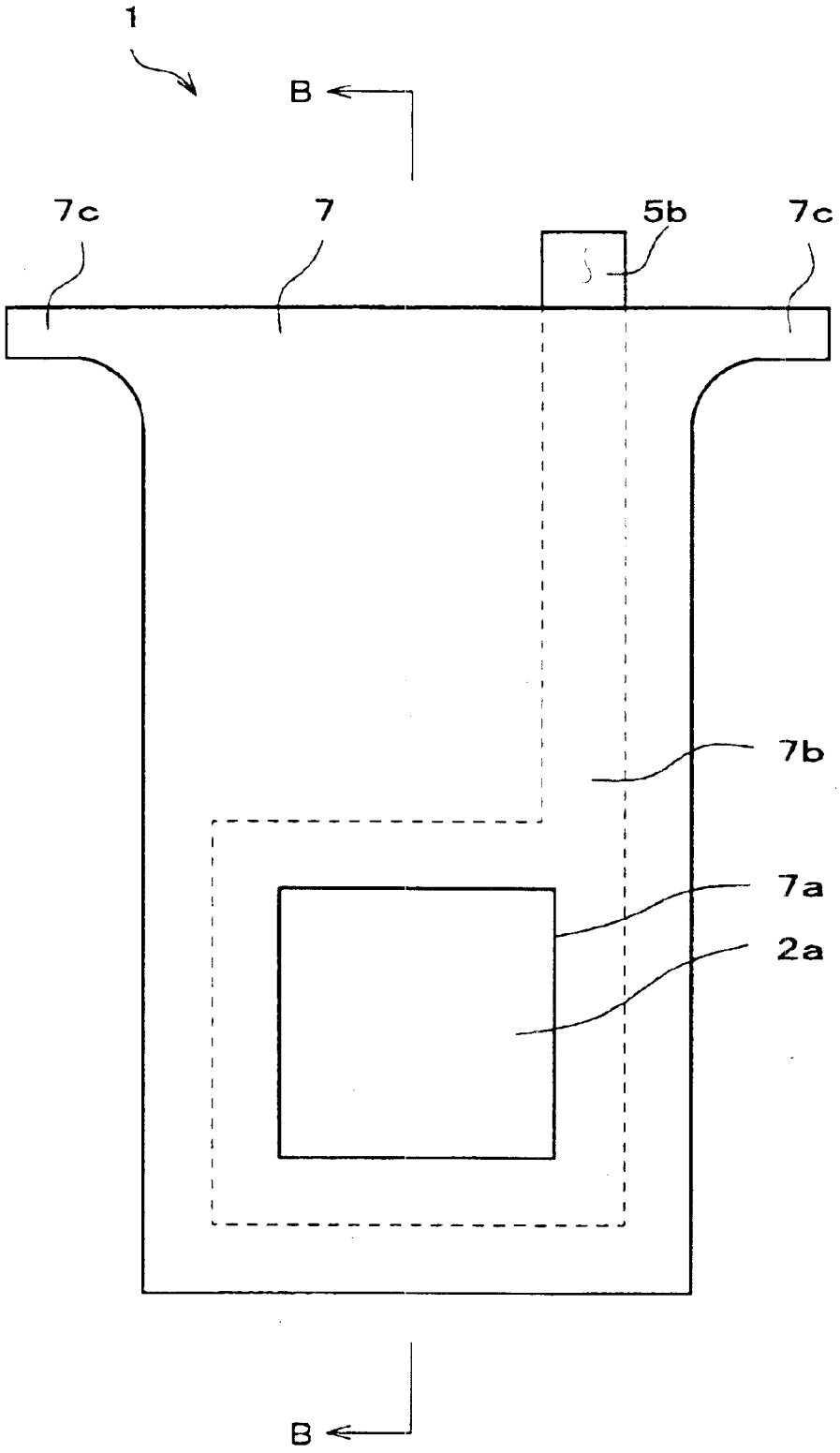
FIG. 2 is a drawing taken along arrow A of FIG. 1.

According to the above mentioned fixation, the cathode cartridge 1 and silicon wafer 2 (hereinafter referred to as a cathode board 1) have an appearance as shown in FIG. 2 taken by seeing through from front side of the front side insulator 7, in which there is the plated parts 2*a* of the silicon wafer 2 exposed to sight by the hole 7*a*.

In addition to the above, there is the power supply-connecting part 5*b* of the cathode conductor 5 protruded upwards over the front side insulator 7 in order that the cathode plate 1 can be connected with a power source for a testing device for electroplating in the place that is not soaked in the plating solution when the cathode board 1 is equipped with a plating tank.

Subsequently, according to the anode cartridge 8 of the invention, there is such a construction thereof described as follows, referring to FIGS. 5 to 7.

Figure 5:
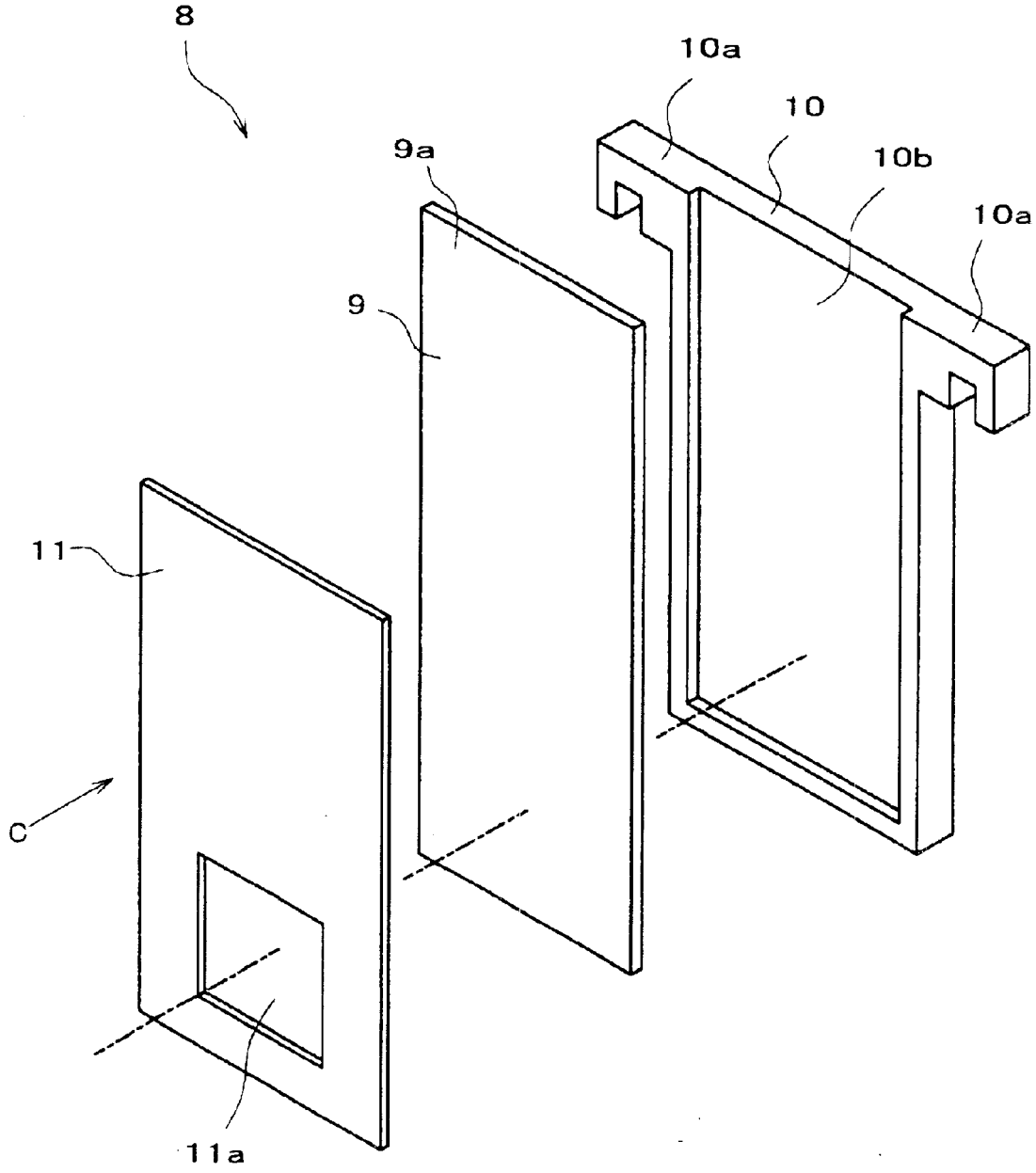
FIG. 5 is an exploded perspective illustration of an anode cartridge of testing device for electroplating referring to a form of enforcement of the invention.

FIG. 5 is an exploded perspective illustration of an anode cartridge 8 of testing device for electroplating referring to a form of enforcement of the invention.

Figure 6:
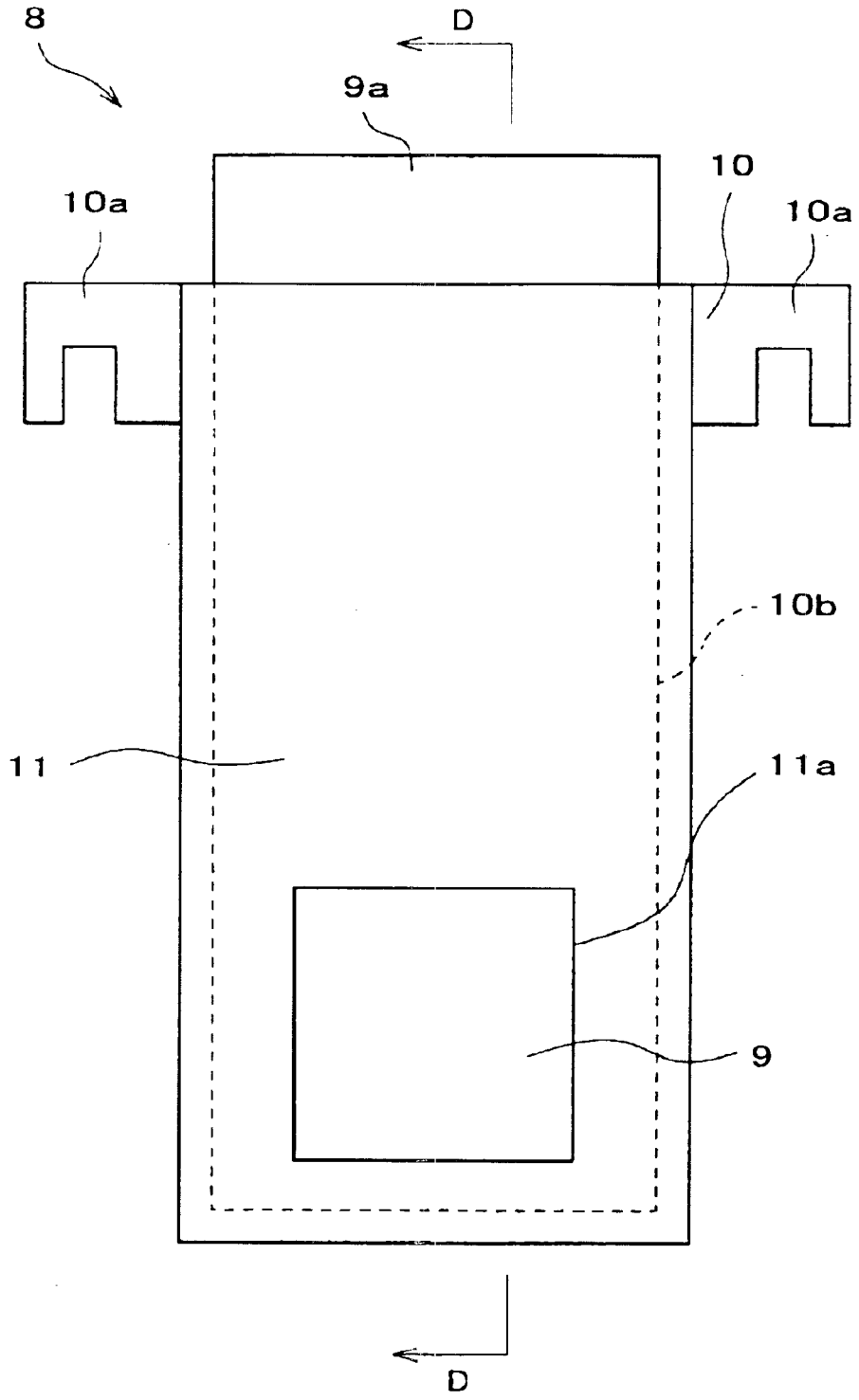
FIG. 6 is a perspective view of C of FIG. 5.

FIG. 6 is a perspective view of C of FIG. 5.

Figure 7:
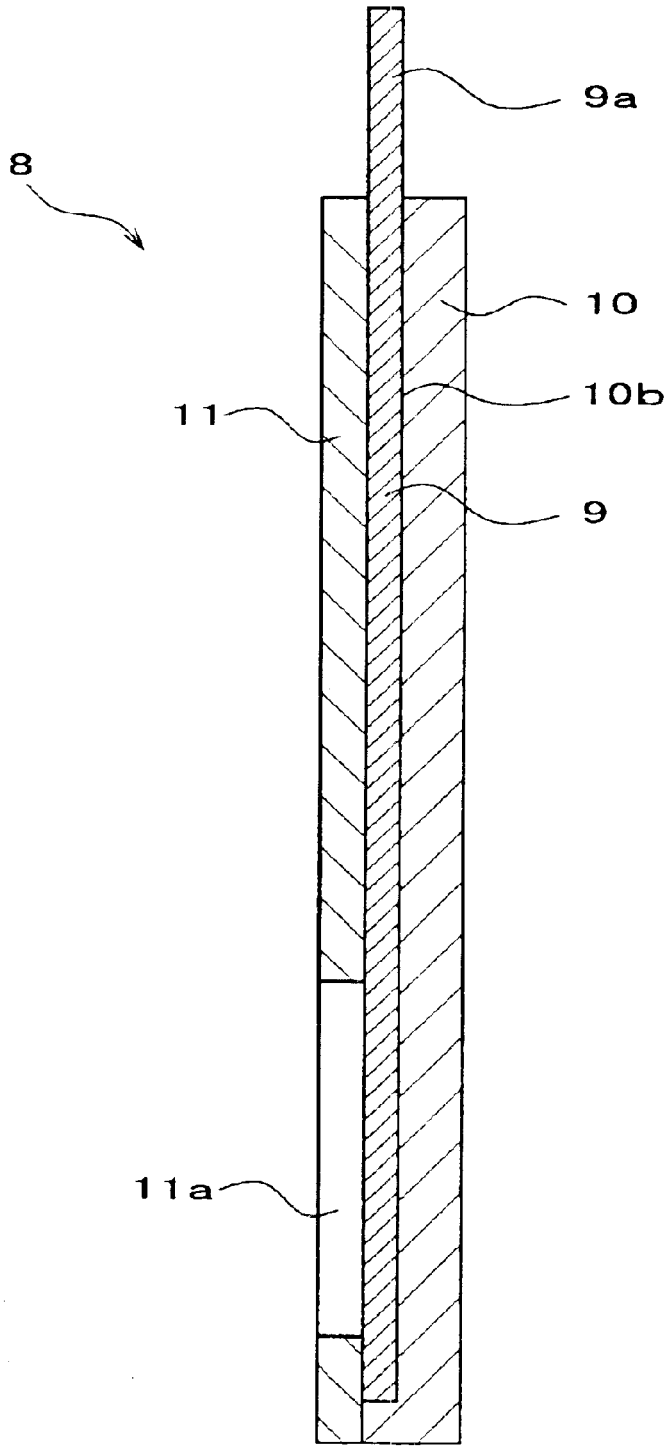
FIG. 7 is a sectional view taken along D—D line of FIG. 6.

FIG. 7 is a sectional view taken along D—D line of FIG. 6.

As shown in FIG. 5, the anode cartridge 8 comprises: an anode conductor 9, a first insulator 10 covering one side of the anode conductor 9 and a second insulator 11 covering the other side of the anode conductor 9

The anode conductor 9 is comprised a thin board such as copper, nickel or the like, which is covered at one side thereof by the first insulator 10 that is made of acrylic board. The first insulator 10 is equipped with an insulator to be supported 10*a* at each shoulder thereof respectively, by which the anode cartridge 8 is hung on a plating tank of testing device for electroplating and there is a recess 10*b* provided for the anode conductor 9 to fit in just.

The other side of the anode conductor 9 is covered by the second insulator 11 made of acrylic board. The second insulator 11 has an open hole 11*a* formed into the same shape to that of the plated parts 2*a* of silicon wafer 2 incorporated in the cathode cartridge 1.

Then, as shown in FIG. 7, the first insulator 10 and the second insulator 11 are fixed firmly with the anode conductor 9 between, owing to uniting both the first insulator 10 and the second insulator 11 each other with resin made screws (not shown).

The anode cartridge 8 screwed each other (hereinafter referred to as anode board) presents such an appearance as is shown in FIG. 6 taken by seeing through from a side of the second insulator 11, in which there is the anode conductor 9 exposed at the hole 11*a*.

Besides, there is upper part 9*a* of the anode conductor 9 protruded upward over both the first anode insulator 10 and the second anode insulator 11, in order that the testing device for electroplating is connected with a power source for it in the place that is not soaked in the plating solution when the anode board 8 is equipped with the plating tank of testing device for electroplating.

Subsequently, according to the invention, there is the testing device for electroplating 12 provided, which is worked using both the cathode board 1 and the anode board 8 and to be described below, referring to FIGS. 8 to 9.

Figure 8:
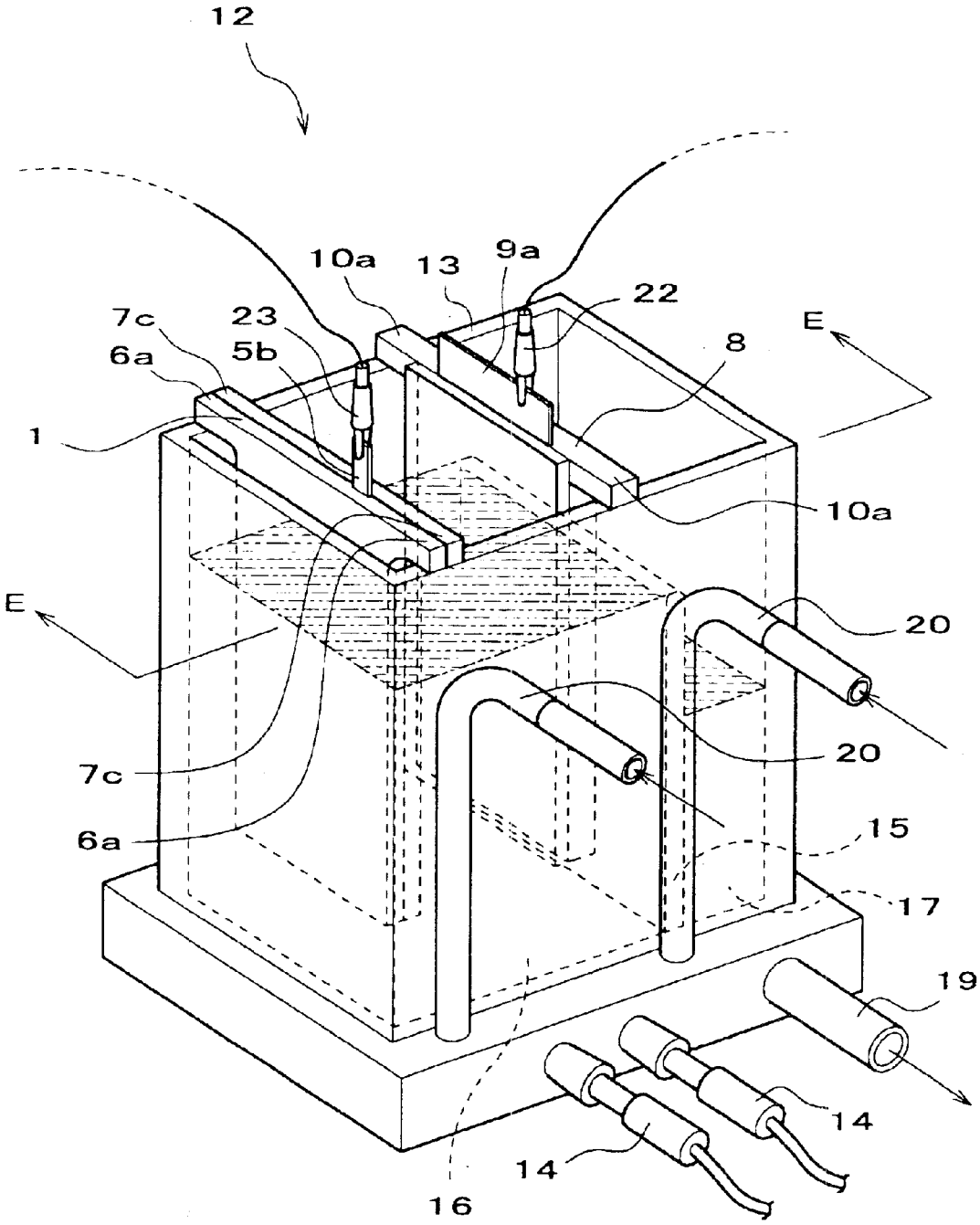
FIG. 8 is a perspective illustration showing the appearance of a testing device for electroplating.

As shown in FIG. 8, the testing device 12 comprises the plating tank 13, the cathode board 1, the anode board 8, a heater 14, a circulating pump (not shown), and a power source (not shown).

The plating tank 13 made up of acrylic board is classified in a plating tank 16 and a drainage tank 17 by a diaphragm 15, in which the former is larger in capacity than the latter. (see to FIG. 9).

In the plating tank 16, a plating solution that contains a positive ion such as copper ions, and the like is poured and the solution that overflowed from the plating tank 16 exceeds the diaphragm 15 and comes to flow into the drainage tank 17.

There is the cathode board 1 is arranged by side of an opposite wall to the diaphragm 15 in the plating tank 16, and wherein, an insulator to be supported 6*a*, 6*a*, and the insulator to be supported 7*c*, 7*c* are hung on edge of the plating tank 13. As for the anode board 8, it is arranged by side of diaphragm 15 opposed to the cathode board 1 in the plating tank 16, wherein, the insulator to be supported 10*a* is hung on edge of the plating tank 13.

In addition, as to the cathode board 1 and the anode board 8, they are disposed on the condition that the plating parts 2*a* of the silicon wafer 2 of the former 1 lies face to face with the open hole 11*a* of the second insulator 11 of the latter 8.

Figure 9:
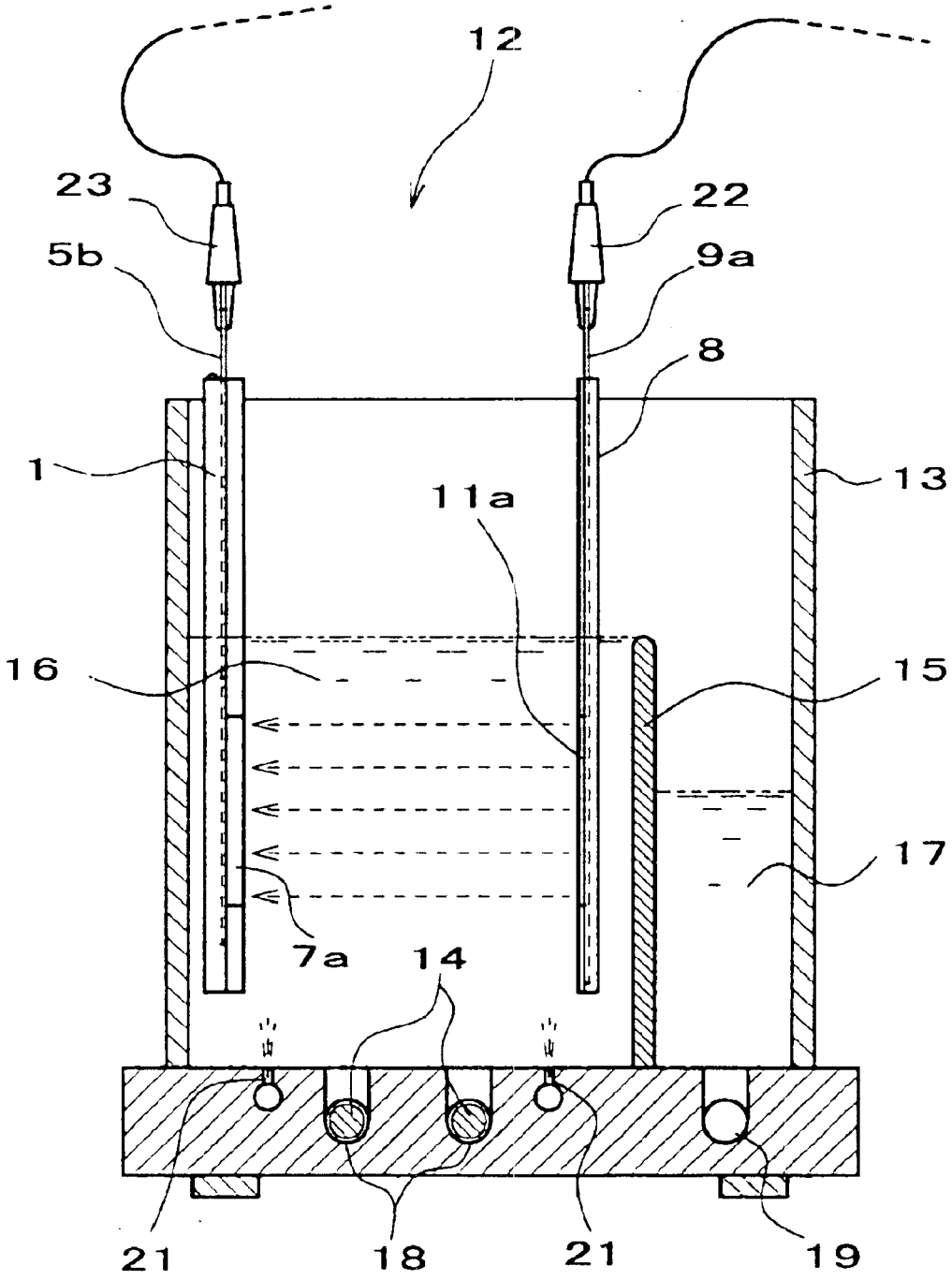
FIG. 9 is a sectional view taken along E—E line of FIG. 8.
Figure 10:
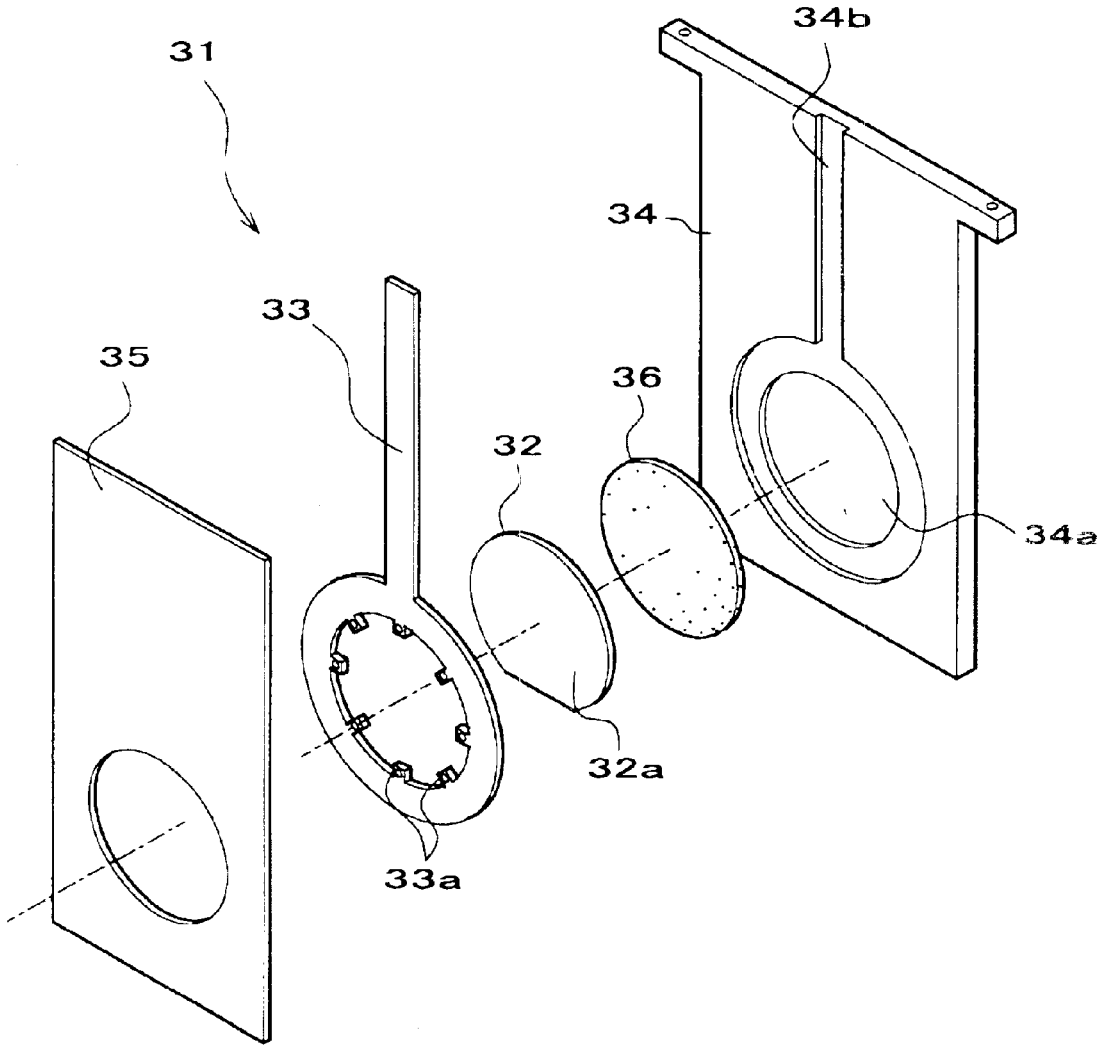
FIG.10 PRIOR ART
FIG. 10 is an exploded perspective illustration of a current cathode cartridge of testing device for electroplating and a silicon wafer.
Figure 11:
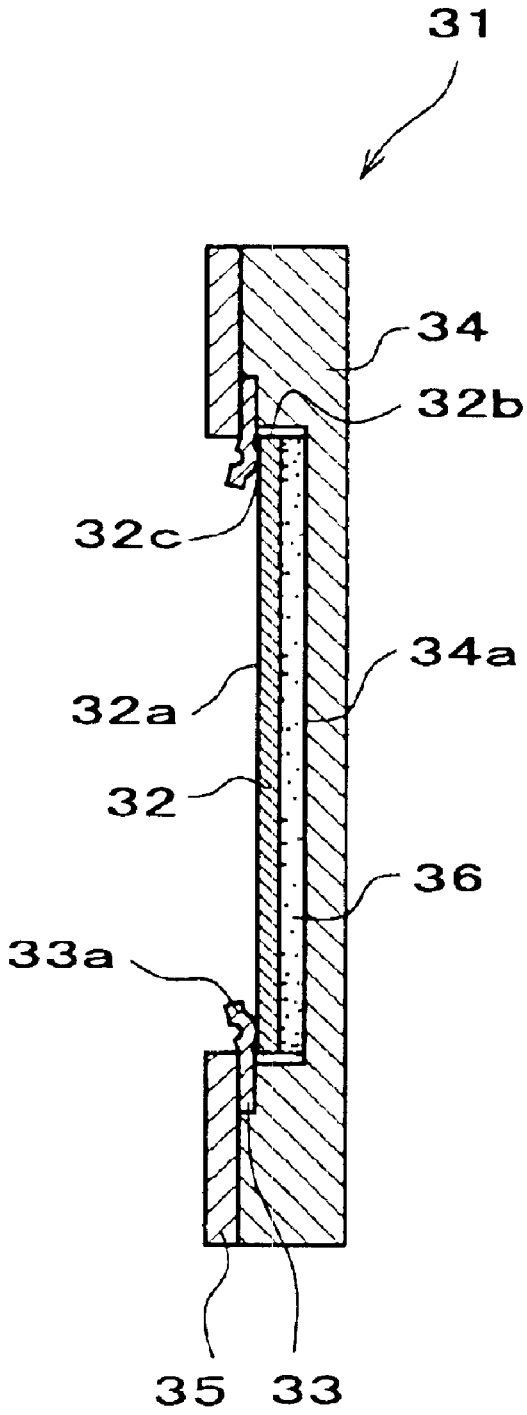
FIG.11 PRIOR ART
FIG. 11 is a sectional view of a conventional cathode cartridge.
Figure 12:
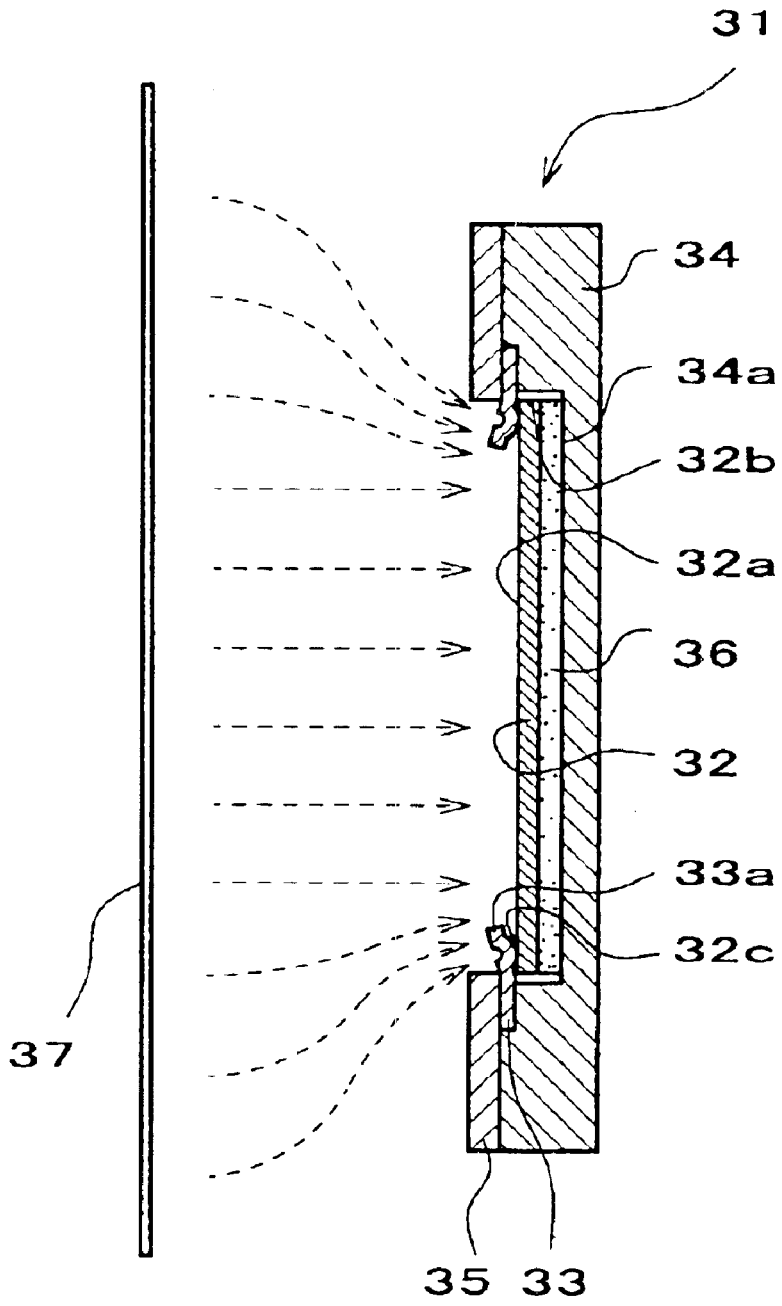
FIG.12 PRIOR ART
FIG. 12 is a sectional view of a conventional cathode cartridge and a positive pole.

The heater 14, as shown in FIG. 9, is inserted into a heater installation hole 18 provided from the flank side at a certain depth, which has an open hole formed at bottom parts of the plating tank 16. And more, since the entry to the heater installation hole 18 is made airtight with rubber stopper, so that the plating solution is intercepted from leaking.

Furthermore, there is a circulation pump (not shown) provided in the device, which absorbs the plating solution in the drainage tank 13 by a drainage hole 19 provided in bottom parts of the drainage tank 17 from the lateral side thereof, and which forwards the plating solution in the plating tank 16 through a inflow hole 20 formed on the flank of the plating tank 13.

The plating solution absorbed through a inflow hole 20 comes to be thrown up powerfully from an exhaust nozzle 21, that is connected to the inflow hole 20. There is a plurality of the exhaust nozzle 21 bored in the bottom of the plating tank 16, which are formed respectively in line at near distance (approximately 1~2 mm) from the plated parts 2*a* of the cathode board 1 and similarly from the opposing side of the anode board 8 to the cathode board 1.

Moreover, the power source (not shown) is equipped with terminals 22 and 23. Terminal 22 is connected with the upper part 9*a* of the anode conductor 9 of the anode board 8 and the terminal 23 is joined to the power supply connecting part 5*b*.Still more, the terminals 22 and 23 are connected with both the upper part 9*a* of the anode conductor 9 and the power supply part 5*b* respectively in the place that is not soaked in the plating solution.

The cathode cartridge 1 of testing device for electroplating, the anode cartridge 8 and the testing device for electroplating 12, which are constituted mentioned above, are operated in the following way.

First, plating solution is put in a plating tank 13 to a little low level than a height of a diaphragm 15, and a circulation pump is switched on, a positive pole of a power source is connected to terminal 22, and the negative pole of a power source is connected to terminal 23.

It is started by above-mentioned operations that the plating to a plated parts 2*a* of a silicon wafer 2 that is a plated base, and, in the plating to continue, the present invention produces actions to be obtained by next operations for electroplating in the following way.

As for the cathode cartridge 1, as shown in FIG. 3, since the silicon wafer 2 is put right closely in a recess 3*a* of a first elastic thin board 3, each of a flank side 2*b* and a reverse side 2*c* of the silicon wafer 2 is intercepted from the plating solution's invading therein. In addition, the peripheral parts 2*d* of the plated parts 2*a* of the silicon wafer 2, to which a second elastic thin board 4 sticks closely, and is intercepted from the plating solution's invading thereon.

That is to say, the parts contained in the negative pole, that is except the plated parts 2*a* of silicon wafer 2, are all intercepted from the plating solution's invading in.

As for the anode cartridge 8, as shown in FIG. 9, an anode conductor 9 of the anode cartridge 8 is exposed to only a part that is the open hole 11*a* formed in a second insulator 11, to which the plated parts 2*a* of silicon wafer 2 opposes face to face. Therefore, lines of electric force generated from the anode conductor 9 and passed by the open hole 11*a* of the second insulator, enter into the plating parts 2*a* uniformly.

Further more, since there is the second insulator 11 provided so that putting on and taking off may be free for the first insulator 10 or the anode conductor 9, according to a shape of the plating parts 2*a* of the silicon wafer 2, it is possible to use the second insulator 11, in which there is an open hole 11*a* formed with a same shape corresponding to that of the plating parts 2*a*.

According to the present invention, there is a form of an embodiment described above. However, this invention is not limited only to an example such as that of the above mentioned, it is possible to provide various variations thereof, provided that they are in a limit on the basis of technical idea of this invention.

As above mentioned in detail, on account of that there are both (a flank and a reverse) sides of a plated base and a peripheral of a plated parts intercepted from plating solution, it is able to get the highest accuracy of the plated parts around by electroplating.

Besides, since there is lines of electric force generated from a positive pole, entering into the plated parts of plated base uniformly.

Moreover, there is the second insulator used, which formed with a same shape to that of the plated parts.

What is claimed is:

1. A cathode cartridge of a testing device for electroplating, said cathode cartridge comprising:

a plated base having a plated part acting as a negative plate;

a tabular cathode conductor having an open hole having the same shape as said plated part of said plated base, said cathode conductor having a plurality of protruding portions that press contact to a peripheral part around said plated part, and which is able to connect with a direct current by an exposed portion thereof not soaked in plating solution;

a first elastic thin board covering a rear side of said plated base and having a recess into which said plated base is retained;

a tabular rear wail insulator covering both a back side of said plated base and a back side of said first elastic thin board, and having a recess into which said plated base and said first elastic thin board are retained;

a tabular front insulator having an open hole having the same shape as said plated part, said front insulator covering a front side of said cathode conductor and having a recess into which said cathode conductor is retained; and a second elastic thin board having an open hole having the same shape as said plated part, said second elastic thin board being sandwiched between said cathode conductor and said plated base, and having a plurality of holes by which said protruding portions of said cathode conductor are guided for passing therethrough.

2. An anode cartridge in combination with a cathode cartridge of a testing device for electroplating, said combination comprising:

a cathode cartridge having a plated part;

a tabular anode conductor arranged to let a front side of said cathode cartridge be opposed thereto, said anode conductor having an exposure part, which can be connected with direct current on a part which does not soak in plating solution;

a tabular first insulator that covers a side of the anode conductor facing in the opposite direction of said cathode cartridge, and which has a recess into which said anode conductor is retained;

a tabular second insulator including an opened hole having a shape corresponding to a said plated part of said cathode cartridge, and covering a side of said anode conductor that faces said cathode cartridge.

3. The anode cartridge according to claim 2, wherein said second insulator is removably secured to one of said first insulator and said anode conductor.

4. The anode cartridge according to claim 2, wherein said opened hole is formed into the same shape as said plated part of said cathode cartridge.

5. The anode cartridge according to claim 2, wherein positive voltage is applied to said anode conductor.

6. The anode cartridge according to claim 2, wherein said second insulator of said anode cartridge prevents exposure of a portion of said anode conductor to plating solution.

* * * * *